US010201818B2

(12) United States Patent
Duffin et al.

(10) Patent No.: US 10,201,818 B2
(45) Date of Patent: Feb. 12, 2019

(54) RUDDER DIRECTED TUBE DELIVERY SPRINKLER HEAD

(71) Applicants: Don D. Duffin, Paul, ID (US); Roger M. Duffin, Paul, ID (US)

(72) Inventors: Don D. Duffin, Paul, ID (US); Roger M. Duffin, Paul, ID (US)

( * ) Notice: Subject to any disclaimer, the term of this patent is extended or adjusted under 35 U.S.C. 154(b) by 278 days.

(21) Appl. No.: 15/337,934

(22) Filed: Oct. 28, 2016

(65) Prior Publication Data

US 2017/0120265 A1 May 4, 2017

Related U.S. Application Data

(60) Provisional application No. 62/248,150, filed on Oct. 29, 2015.

(51) Int. Cl.
*B05B 3/04* (2006.01)

(52) U.S. Cl.
CPC ..... *B05B 3/0481* (2013.01); *B05B 3/0477* (2013.01)

(58) Field of Classification Search
CPC ... B05B 3/0477; B05B 3/0481; B05B 3/0486; B05B 3/0436; B05B 15/65; B05B 15/74; B05B 1/26; B05B 3/003; B05B 3/085; B05B 3/008; B05B 3/06; B05B 3/08; B05B 3/1007
USPC ... 239/227, 222.11–222.21, 225.1, 231, 246, 239/247, 263.3
See application file for complete search history.

(56) References Cited

U.S. PATENT DOCUMENTS

| | | | | |
|---|---|---|---|---|
| 5,372,307 | A | 12/1994 | Sesser | |
| 5,671,886 | A | 9/1997 | Sesser | |
| 6,494,384 | B1 | 12/2002 | Meyer | |
| 6,814,305 | B2 | 11/2004 | Townsend | |
| 6,827,291 | B2 | 12/2004 | Townsend | |
| 7,143,957 | B2 * | 12/2006 | Nelson | B05B 3/005 239/222.21 |
| 7,954,731 | B2 * | 6/2011 | Antonucci | B05B 3/003 239/230 |
| 8,651,400 | B2 | 2/2014 | Walker et al. | |
| 2004/0046055 | A1 * | 3/2004 | Townsend | B05B 3/005 239/463 |
| 2006/0006254 | A1 * | 1/2006 | Meyer | B05B 3/005 239/214 |

* cited by examiner

*Primary Examiner* — Darren W Gorman
*Assistant Examiner* — Juan C Barrera
(74) *Attorney, Agent, or Firm* — Scott D. Swanson; Shaver & Swanson, LLP

(57) ABSTRACT

A rudder-directed tube delivery sprinkler head. A rudder configured to direct water into a tube, triggering distribution of water around an axis. Adjustable stoppers contact a rudder assembly, causing the rudder to pivot, directing water into a different tube and changing the direction of rotation.

12 Claims, 5 Drawing Sheets

RUDDER DIRECTED TUBE DELIVERY SPRINKLER HEAD

PRIORITY/CROSS-REFERENCE TO RELATED APPLICATIONS

This application claims the benefit of U.S. Provisional Application No. 62/248,150, filed Oct. 29, 2015, the disclosure of which is incorporated by reference.

TECHNICAL FIELD

The disclosed technology generally relates to a sprinkler head, and more particularly to a rudder-directed tube delivery sprinkler head.

BACKGROUND

Various methods have been devised to distribute water and other liquids in a circular pattern among agricultural regions. One of the most common methods is through the use of impact sprinklers, which have acquired widespread use since the 1930s. As the name suggests, the impact sprinkler operates in a somewhat noisy and violent manner, and causes the water conduit to which it is attached to rotate and the sprinkler mechanisms to undergo stress. A need exists for improved method of distributing water and other liquids in a circular pattern with less noise and improved wear and tear on the sprinkler parts resulting in greater operating lifespan, plus decrease cost to manufacture.

BRIEF DESCRIPTION OF THE DRAWINGS

FIG. 4 shows the tube assembly in the two positions it takes during operation.

SUMMARY OF THE DISCLOSURE

Figure 1:
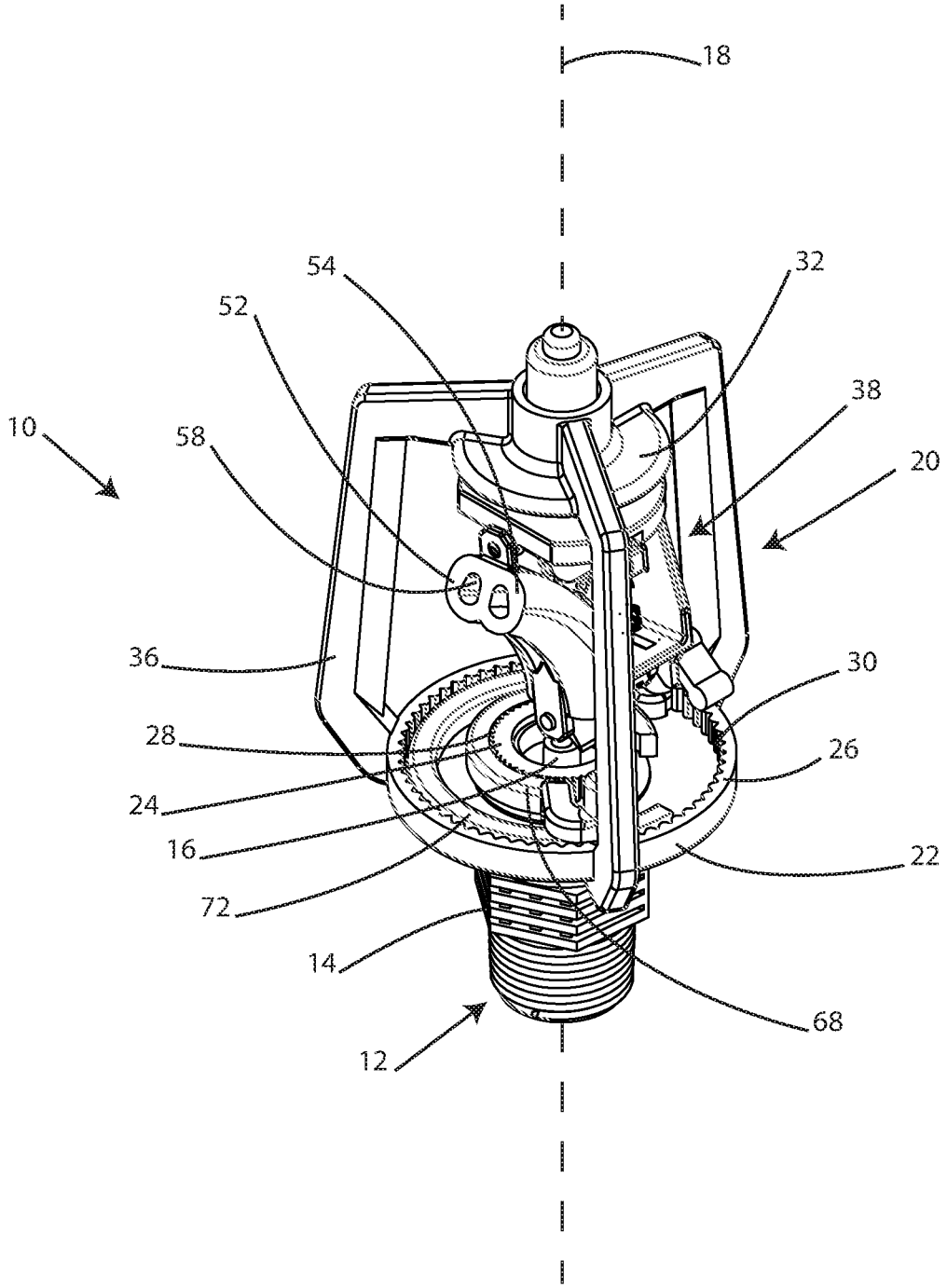
FIG. 1 is a perspective view of the sprinkler head.

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

Disclosed is a sprinkler head. Though it is described below as a water distributing sprinkler head to be used for agricultural irrigation and the like, practitioners in the art will appreciate that it is capable of distributing a variety of liquid materials, such as chemical solutions, as well. The sprinkler head's components may be made of metal, thermoplastic, or other substances or combination of substances to maximize durability and efficiency.

The sprinkler head is positioned at the end of a water delivery source, which is comprised of a water conduit with an attached water nozzle, which is broadly defined to mean any apparatus through which water is expelled from the end of the water delivery conduit. The water delivery conduit and water nozzle are commonly made of metals or durable plastics. The water delivery conduit and the water nozzle are centered around a first axis. The sprinkler head is typically attached to the water delivery source using complimentary threading, but other methods of attachment are possible.

The sprinkler head includes a cage, which has a first end, attached to the water delivery source, and a second end, which is spaced apart from the first end through the use of one or more arms.

A rotatable delivery assembly is attached to and positioned within the cage between the first end and the second end. In one embodiment, the delivery assembly is coupled to the second end of the cage. The second end may take various configurations to accept the delivery assembly. For example, the second end may contain an aperture through which a portion of the delivery assembly defining a bearing fits to secure it to the cage. In another embodiment, the second end may be generally planar and the delivery assembly may simply embrace the edges of the second end. Those skilled in the art will understand that other methods of coupling the delivery assembly to the cage are possible within the scope of the disclosed technology.

The delivery assembly is coupled to the cage such that the delivery assembly is able to rotate around the first axis. This can be accomplished using various methods. For example, the delivery assembly may attach to the second end through the use of an axle and bearing running through the second end aperture described above.

The delivery assembly includes a tube assembly and a rudder sub-assembly. The delivery assembly is configured such that, once the delivery assembly is attached to the cage, the tube assembly is able to rotate around a second axis normal to the first axis. In one embodiment, the delivery assembly also includes a hangar positioned between the tube assembly and the second end. The hangar is rotatably connected to the second end such that the delivery assembly remains able to rotate around the first axis, such as with the bearing/aperture configuration described above. The tube assembly is rotatably coupled to the hangar such that the tube assembly remains able to rotate around the second axis. In one embodiment, this is performed using pegs on the circumference of the hangar and holes near the top of the tube assembly such that, when the pegs are inserted into the holes, the tube assembly hangs freely and rotates around the second axis during operation. Other methods of attaching the tube assembly to the hangar may be used (hooks and loops, hinges, etc.).

It is necessary that the rotation of the tube assembly around the second axis be controlled to maximize the capture of water in the spray tubes as discussed below. Thus, the delivery assembly also includes limit arms that restrict the tube assembly's angle of rotation around the second axis. In one embodiment, the limit arms are attached to the tube assembly and configured to contact the hangar at the maximum desired angle of rotation, thereby stopping the tube assembly's rotation around the second axis, at a point of alignment of the tube to the stream of water.

The tube assembly contains a first spray tube and a second spray tube. Though shown in the figures and described herein as contoured cylinders, the tubes may be open on one side resembling a chute. Each spray tube has an input end, where the water enters the tube, and an output end, where the water leaves the tube. The first spray tube and second spray tube are configured such that, when the delivery assembly is positioned within the cage, the input ends of each of the spray tubes are adjacent and may be alternatingly centered above the water nozzle as allowed by the rotation of the tube assembly around the second axis.

The rudder sub-assembly has a rotatable rudder connected to a control arm. The rudder sub-assembly is attached to the tube assembly below the input ends of the spray tubes such that the rudder sub-assembly is able to pivot around a third axis parallel to the second axis. Because the rudder sub-assembly's angle of rotation also needs to be limited, the tube assembly is configured to restrict the rudder's angle of rotation around the third axis. This can be done by various methods, such as incorporating a physical boundary or brace on either side of the rudder sub-assembly inhibiting the rudder's rotation. The rudder sub-assembly is positioned such that the rudder is below and between the input ends of the spray tubes, and proximal to the water nozzle. This placement allows the rudder to engage with the water flow, causing the rudder sub-assembly and attached tube assembly to rotate around the second axis, thereby centering an input end over the water nozzle.

The sprinkler head includes one or more adjustable directional stoppers coupled to the cage and positionable such that, during sprinkler head operation, the control arm will come into contact with one or more of the directional stoppers, causing the control arm and attached rudder to pivot and engage the flow of water. The directional stoppers can be coupled to the cage through various methods. In one embodiment, the first end of the cage includes an inner rim containing one or more notches, and an outer rim containing one or more grooves. The directional stoppers can be adjustably coupled to the notches and/or grooves and positioned such that the control arm will contact the resistance of the directional stoppers causing the control arm and attached rudder to pivot. The directional stoppers may be removable to allow the sprinkler to rotate in a single direction as desired.

Upon the flow of water through the water delivery conduit and water nozzle, the flow will encounter the rudder, causing the rudder to pivot around the third axis and engage with the water such that the tube assembly is rotated around the second axis until the input end of a spray tube is centered over the water nozzle and the tube assembly's rotation around the second axis is stopped by a limit arm. Upon the filling of the engaged spray tube, the flow of water through the delivery assembly exerts a rotational force around the first axis, causing the delivery assembly to rotate around the first axis until the control arm contacts a directional stopper. Once the control arm contacts a directional stopper, the control arm and the rudder pivot around the third axis and engage with the water flow again, thereby forcing the rudder and attached tube assembly to rotate around the second axis in the opposite direction until the input end of the other spray tube is centered over the water nozzle and further tube assembly rotation is prevented by the other limit arm, at which point the process repeats, causing the delivery assembly to rotate in the opposite direction around the first axis.

The rudder sub-assembly may also include a retaining spring connected to the rudder/control arm and the tube assembly. The retaining spring is used to minimize the free movement of the rudder by allowing the rudder to pivot between the extreme ends of its angle of rotation, while otherwise maintaining the rudder at one of the extreme ends of its angle of rotation. As mentioned, the tube assembly is configured to restrict the rudder's angle of rotation around the third axis. Through the use of the retaining spring, the rudder will be held at a limit of its angle of rotation (i.e. against one of the braces) until encountering a force, such as the directional stopper contacting the control arm, sufficient to cause the rudder to pull away from one limit of its angle of rotation. As the rudder pulls away from one limit of its angle of rotation, it temporarily stretches the spring. As the rudder pivots past the inflection point and starts pivoting toward the other limit of its angle of rotation, tension on the spring begins releasing and the rudder comes to rest at the other limit of its angle of rotation. At either limit, there is sufficient tension on the spring to prevent the rudder and control arm from hanging freely under the tube assembly.

As described above, upon encountering the water flow the delivery assembly will turn around the first axis. To prevent the delivery assembly from turning too quickly or violently, the sprinkler head may incorporate the use of a dampener when connecting the delivery assembly to the cage. This dampener can be of various types, such as fluid or friction based, and is capable of modulating the speed at which the delivery assembly rotates around the first axis under a variety of water pressures. The modulation can be adjusted by the user.

Though the water will flow through the tubes in the general embodiment described above, it is within the disclosure to modify the tubes to affect the behavior of the water flow within the tube and after the water has exited the tube. For example, in one embodiment, the input ends of the first and second spray tubes is larger than each of the spray tubes' output ends, and the interiors of both of the spray tubes are tapered, increasing the speed and containment of the water upon exit. The interior of the first spray tube and/or second spray tube may also be contoured or otherwise modified with grooves, teeth, or steps such that the water simultaneously exiting from the output ends of the first spray tube and/or second spray tube travels different distances or in different spray patterns thereby enabling a larger area to be watered. It is within the scope of the disclosure that various combinations of tapering and contouring may be used in one or both spray tubes to achieve the desired behavior of the water or other fluid being distributed.

Although the disclosure identifies the spray tubes as "first" and "second," these designations are not anatomically relevant to the function of the rudder sub-assembly. Rather, they are designated "first" and "second" for the purpose of describing the general operation of the sprinkler head.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

While the presently disclosed technology is susceptible of various modifications and alternative constructions, certain illustrated embodiments thereof have been shown in the drawings and will be described below in detail. It should be understood, however, that there is no intention to limit the claimed technology to the specific form disclosed, but, on the contrary, the presently disclosed and claimed technology is to cover all modifications, alternative constructions, and equivalents falling within the spirit and scope of the inventive concept(s) as defined in the claims.

FIG. 1 shows a perspective view of the disclosed sprinkler head 10 in its vertical orientation. The sprinkler head 10 is connected to a water delivery source 12, which includes a water nozzle 16 affixed around or otherwise integrated into an opening of a water conduit 14. The water conduit 14 and water nozzle 16 are centered around a first axis 18. The sprinkler head includes a cage 20 with a first end 22 and a second end 32. The first end 22 and second end 32 are spaced apart by one or more arms 36. In the embodiment shown, the sprinkler head 10 is attached to the water delivery source 12 by the first end 22 using a threaded connection allowing the water to be directed into the cage 20. In this embodiment, the first end 22 also includes an inner rim 24 containing one or more notches 28 and an outer rim 26 containing one or more grooves 30. These notches and groves are used to affix and adjust one or more directional stoppers 68, 72 (discussed below). Other structures can be used to set reversing points and limits.

The sprinkler head 10 further includes a rotatable delivery assembly 38 coupled to the cage 20 and positioned between the first end 22 and the second end 32. The delivery assembly 38 is configured to rotate around the first axis 18 and includes first and second spray tubes 52 and 54 which direct a stream of water outward from the sprinkler.

Figure 2:
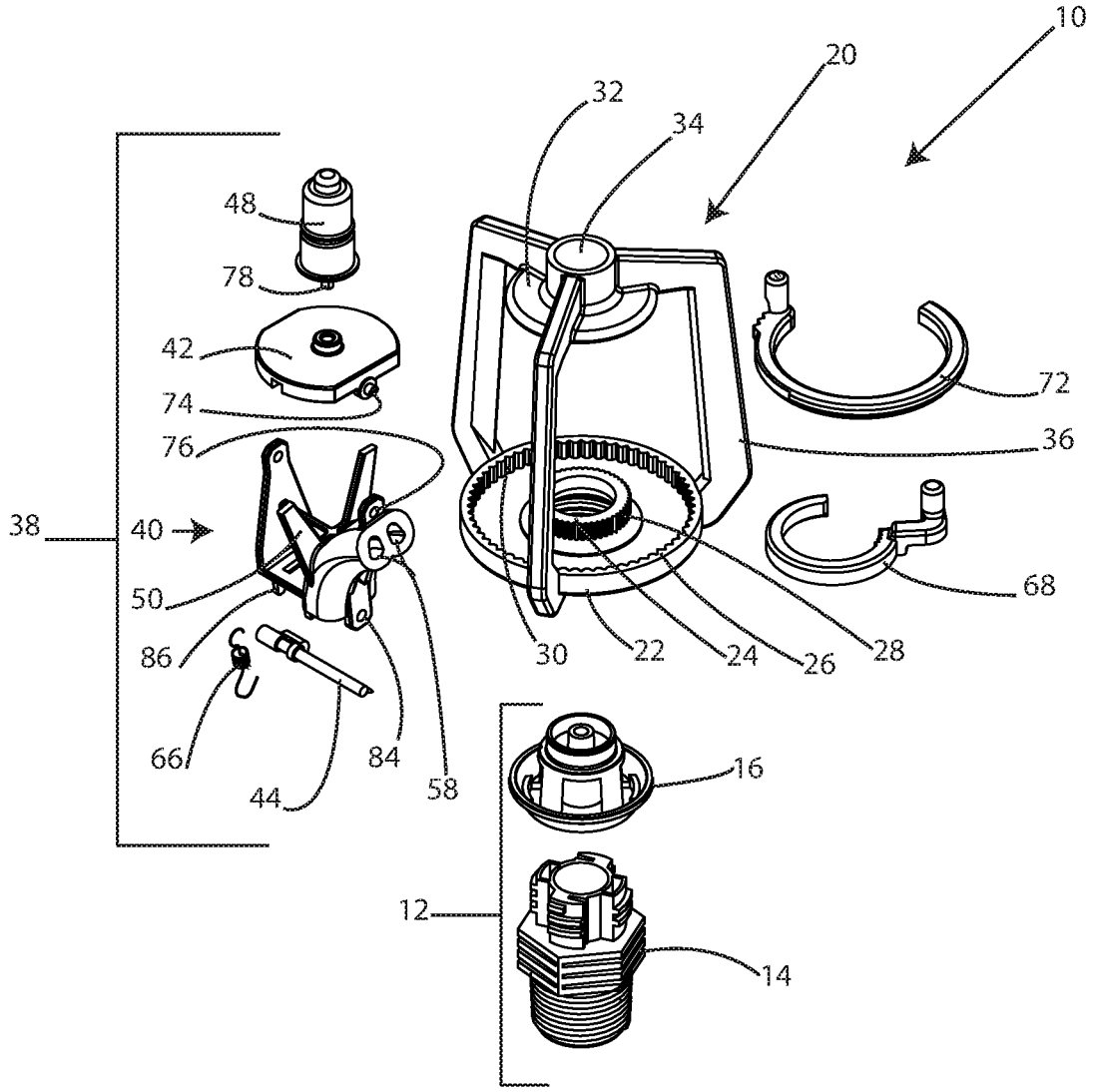
FIG. 2 is an exploded view of the parts of the sprinkler head.

FIG. 2 shows the sprinkler head 10 in an exploded view, giving greater visibility to some of the parts. The delivery assembly 38 is made up of a tube assembly 40 and a rudder sub-assembly 44. It is within the scope of the disclosure that the tube assembly 40 may be directly coupled to the cage 20 in a manner that allows the tube assembly 40 to rotate around a second axis 46 normal the first axis 18. In the embodiment shown, the delivery assembly 38 includes a hangar 42 positioned between the tube assembly 40 and the second end 32 of the cage 20. An axle 78 and bearing 70 with integrated dampener 48 is attached to the hangar 42 and inserted into the aperture 34 of the second end 32, thereby attaching the delivery assembly 38 within the cage 20.

The tube assembly 40 includes a first spray tube 52 and a second spray tube 54, best shown in FIG. 1. Each spray tube has an input end 56 designed to receive the flow of water, and an output end 58 from which the water is released and distributed. The output ends 58 are best shown in FIG. 1 and FIG. 2, while the presence of the input ends 56 can be viewed as part of the cut away of the tube assembly 40 in FIG. 5. As further shown in FIG. 5, the first spray tube 52 and second spray tube 54 are configured within the tube assembly 40 such that the input ends of the spray tubes are adjacent to each other. The tube assembly 40 is positioned within the cage 20 such that the input ends of the spray tubes are located above the water nozzle 16. As described below, the spray tubes 52 and 54 can have decreasing inner diameter(s), be open on one side forming a chute, and/or have bumps or teeth on the inner surface.

Figure 3:
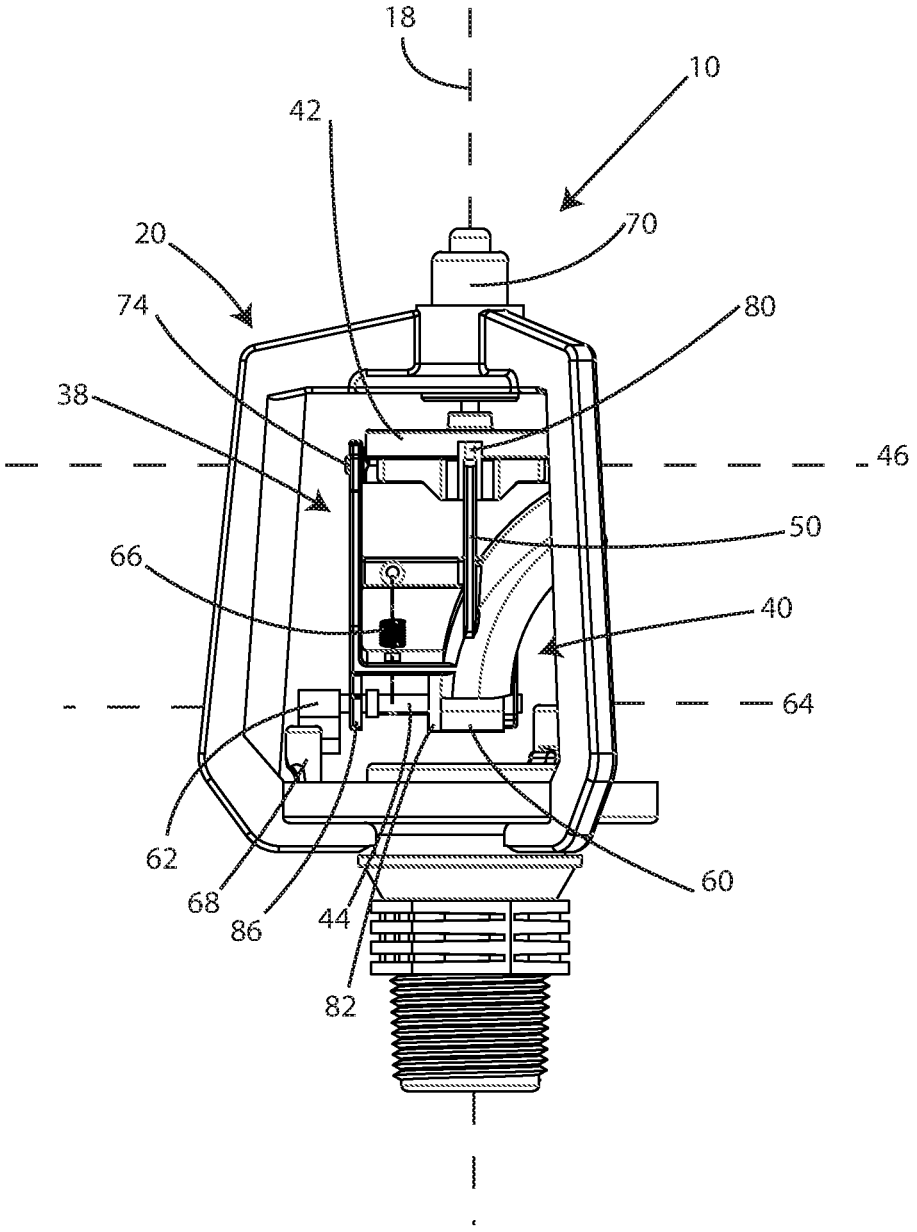
FIG. 3 is a side view of the sprinkler head in a vertical orientation.

FIG. 3 is a side view of the sprinkler head 10 showing the second axis 46 around which the tube assembly 40 rotates. FIG. 3 also shows the third axis 64 around which the rudder sub-assembly 44 rotates. The entrance of water into a spray tube exerts a force on the interior of the spray tube. Allowing the tube assembly 40 limited rotation around an axis normal to the first axis 18 causes the delivery assembly 38 to rotate around the first axis 18. Thus, as shown in FIG. 3, the delivery assembly 38 is coupled to the cage 20 such that the delivery assembly 38 is able to rotate around a second axis 46 normal to the first axis 18. In the embodiment shown, this is accomplished through the use of pegs 74 on the hangar 42 and corresponding holes 76 on the tube assembly 40. The pegs 74 and holes 76 are also visible in FIG. 2. Placing the holes 76 over the pegs 74 allows the tube assembly 40 to rotate within the cage 20 around the second axis 46. The degree of rotation is restricted through the use of limit arms 50 connected to the delivery assembly 38. In the preferred embodiment, the limit arms 50 are configured to contact the hangar 42 at limits 80, stopping further rotation of the tube assembly 40. Structures to attach and position the tube assembly 40, limit arms 50, and the tubes 52 and 54 can take various forms.

As shown in FIG. 3, the delivery assembly 38 also includes a rudder sub-assembly 44 attached to the tube assembly 40. The rudder sub-assembly 44 includes a rudder 60 and a control arm 62. The rudder sub-assembly 44 is attached to the tube assembly 40 such that the rudder sub-assembly 44 is able to rotate around a third axis 64 parallel to the second axis 46. The rudder sub-assembly 44 is configured and attached such that the rudder 60 is located below and between the input ends of the spray tubes. The tube assembly 40 is configured to constrict the rotation of the rudder sub-assembly 44 around the third axis 64 through the use of some barrier to rotation.

In the embodiment shown in FIG. 3, the rudder sub-assembly 44 is attached to the tube assembly 40 through the use of a slot 84 and mounts 86 into which the rudder sub-assembly is inserted and clipped, respectively. This can be seen in FIG. 2 and FIG. 3. In this embodiment, the braces 82 used to limit the rotation of the rudder 60 are incorporated into the tube assembly 40. The rudder sub-assembly 44 also includes a retaining spring 66 connecting the rudder 60 and control arm 62 to the tube assembly 40. The retaining spring 66 serves to maintain the rudder 60 at limit of its rotation until the control arm 62 encounters a force great enough to cause the rudder 60 to pivot to the opposite limit of its rotation.

Figure 4:
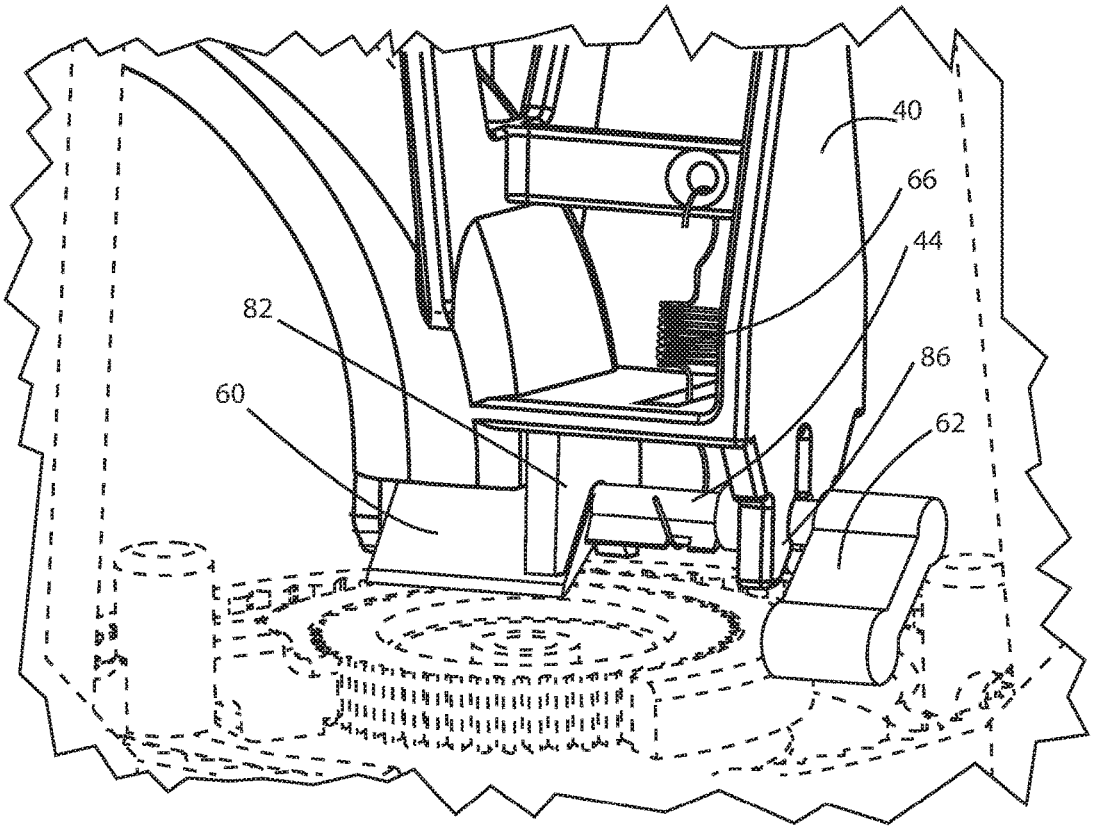
FIG. 4 is a cross-section of the sprinkler head with the spray tubes facing away.

FIG. 4 is an enlarged view of the lower portion of the tube assembly 40, retaining spring 66, and rudder sub-assembly 44. The rudder 60 and control arm 62 are visible. The mounts 86 by which the rudder sub-assembly 44 is attached, and the braces 82 that limit the rotation of the rudder sub-assembly 44, are also seen.

As shown most clearly in FIGS. 1 and 2, the sprinkler head 10 also includes one or more directional stoppers 68, 72 that are adjustably coupled to the cage 20 and positioned such that, during sprinkler operation, the control arm 62 will contact one or more directional stoppers 68, 72, causing the control arm 62 and rudder 60 to pivot such that the rudder 60 engages the water flow. In the embodiment shown, two separate directional stoppers 68, 72 are used. An inner stopper 68 is coupled to one or more notches 28 located on the inner rim 24 of the first end 22 of the cage. An outer stopper 72 is coupled to one or more grooves 30 located on the outer rim 26 of the cage 20. The directional stoppers 68, 72 can be adjusted around the grooves 30 and notches 28 to expand or contract the degree of rotation of the delivery assembly 38 around the first axis 18. Structures to set the arc of rotation and point of reversal can take other forms which are known in this art.

Figure 5:
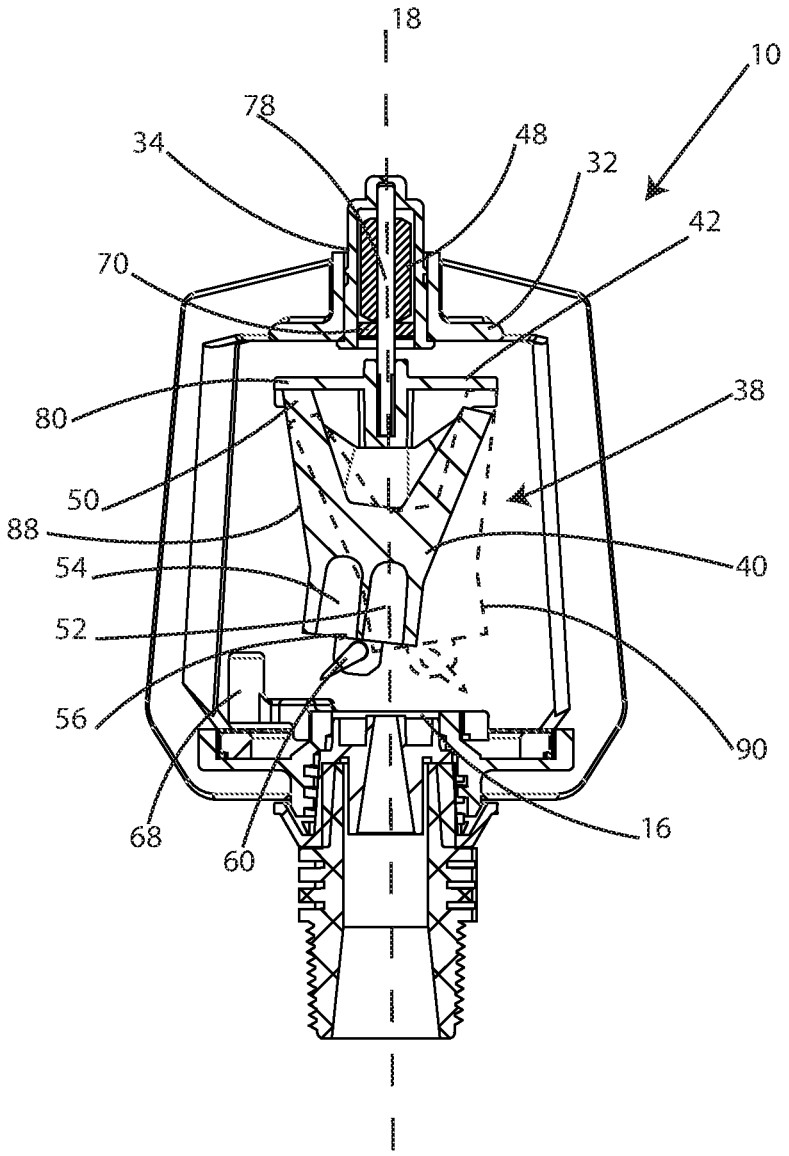
FIG. 5 is an enlarged view of the bottom of the tube assembly and rudder sub-assembly.

As shown in FIG. 5, a dampener 48 is used to modulate the speed of rotation of the delivery assembly 38. The dampener can use viscous fluid, friction, or some other method to slow the rotational speed. In the embodiment shown, the delivery assembly 38 is attached to the second end 32 using an axle 78 and a bearing 70 attached to the hangar 42 and inserted into an aperture 34 in the second end 32.

FIG. 5 also shows a cross-section of the sprinkler head with the spray tubes facing away and shows the tube assembly at its limits of rotation. In operation, the water exits the water nozzle 16 and engages with the rudder 60, causing the tube assembly 40 to rotate around the second axis 46, thereby centering the input end 56 of the first spray tube 52 over the water nozzle 16. At this point, a limit arm 50 contacts the limit 80 and the tube assembly 40 is stopped at one of its limits of rotation, or Position 1, identified as 88 and represented in FIG. 5 by the solid line tube assembly 40. The delivery assembly 38 rotates around the first axis 18 until the control arm 62 contacts a directional stopper 68, 72. This causes the control arm 62 and attached rudder 60 to pivot around the third axis 64 until the rudder 60 engages with the water flow. This engagement forces the rudder 60 and attached tube assembly 40 to rotate around the second axis 46 in the opposite direction, moving the input end 56 of the second spray tube 54 over the water nozzle 16 until the input end 56 of the second spray tube 54 is centered over the water nozzle 16 and the opposite limit arm 50 contacts the corresponding limit 80, at which point the tube assembly comes to rest in Position 2, identified as 90 and represented by the dotted outline in FIG. 5. The delivery assembly then rotates the opposite direction around the first axis 18 as the process repeats.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A water distributing sprinkler head, comprising:

a water delivery source, comprising a water conduit with a water nozzle, said water conduit and water nozzle centered around a first axis;

a cage having a first end attached to said water delivery source, and a second end, with said first end and said second end spaced apart by one or more arms;

a rotatable delivery assembly attached to and positioned within said cage between said first end and said second end, and having a tube assembly and a rudder sub-assembly, said rotatable delivery assembly mounted to said cage such that said rotatable delivery assembly is able to rotate around said first axis, and such that said tube assembly is able to rotate side to side around a second axis normal to said first axis;

said rotatable delivery assembly having one or more limit arms positioned such that said limit arms restrict the angle of rotation of said tube assembly around said second axis;

said tube assembly having a first spray tube and a second spray tube, each spray tube having an input end and an output end, said tube assembly configured such that the input ends of said first spray tube and said second spray tube are adjacent to each other and may be alternatingly centered above said water nozzle;

said rudder sub-assembly having a rotatable rudder connected to a control arm, said rudder sub-assembly attached to said tube assembly such that said rudder sub-assembly is able to pivot around a third axis parallel to said second axis with said tube assembly configured to restrict the angle of rotation of said rudder sub-assembly around said third axis, and positioned such that said rudder is below and between the input ends of said spray tubes, and proximal to said water nozzle; and one or more directional stoppers connected to said cage and positionable such that, during sprinkler head operation, said control arm will contact said one or more directional stoppers causing said control arm and attached rudder to pivot;

wherein, upon the flow of water through said water delivery conduit and attached water nozzle, the flow will encounter said rudder, causing said rudder to pivot around said third axis and interact with said flow such that the rudder and attached tube assembly rotate around said second axis and, upon the filling of said first spray tube, exert rotational force around said first axis, causing said rotatable delivery assembly to rotate around said first axis until said control arm contacts said one or more directional stoppers, which causes said control arm and said rudder to pivot around said third axis and causes said rudder to engage the flow of water such that the rudder and attached tube assembly rotate around said second axis in the opposing direction, moving the input end of the second spray tube over the water nozzle, allowing the flow to enter the second spray tube, at which point the process repeats.

2. The water distributing sprinkler head of claim 1, wherein said rotatable delivery assembly includes a hangar, said hangar rotatably connected to said second end such that said rotatable delivery assembly remains able to rotate around said first axis, with said tube assembly coupled to said hangar such that said tube assembly remains able to rotate around a second axis perpendicular to said first axis.

3. The water distributing sprinkler head of claim 1, wherein said second end contains an aperture and said rotatable delivery assembly contains a bearing configured to securely lodge within said aperture, such that said rotatable delivery assembly is connected to said cage while remaining able to rotate around said first axis.

4. The water distributing sprinkler head of claim 1, wherein said first end includes an inner rim and an outer rim, said inner rim containing one or more notches, with said outer rim containing one or more grooves, such that said one or more directional stoppers can be adjustably coupled to said one or more notches and/or one or more grooves and positioned such that said control arm will contact said one or more directional stoppers causing said control arm and attached rudder to pivot.

5. The water distributing sprinkler head of claim 1, wherein said input end of said first spray tube and/or said second spray tube is larger than said output end of said first spray tube and/or said second spray tube, and the interior of said first spray tube and/or said second spray tube is tapered.

6. The water distributing sprinkler head of claim 1, wherein the interior contouring of said first spray tube and/or said second spray tube is modified such that the water simultaneously exiting from one or both of said output ends travels different distances thereby enabling a larger area to be watered.

7. The water distributing sprinkler head of claim 1, wherein said delivery assembly includes a dampener to modulate the rotational speed of said delivery assembly around said first axis.

8. The water distributing sprinkler head of claim 1, wherein said rudder sub-assembly includes a retaining spring connecting said rudder sub-assembly to said tube assembly, said tube assembly configured to use the resistance of said retaining spring to maintain said rudder at a limit of its angle of rotation until encountering a force sufficient to cause said rudder to pivot toward the other limit of its angle of rotation.

9. The water distributing sprinkler head of claim 1, wherein said directional stoppers are removable.

10. A water distributing sprinkler head, comprising:

a water delivery source, comprising a water conduit with a water nozzle, said water conduit and water nozzle centered around a first axis;

a cage having a first end secured to said water delivery source, and a second end, with said first end and said second end spaced apart by one or more arms;

a rotatable delivery assembly attached to and positioned within said cage between said first end and said second end, and having a tube assembly, a hangar, and a rudder sub-assembly, said hangar mounted to said second end such that said rotatable delivery assembly is able to rotate around said first axis, and said tube assembly coupled to said hangar such that said tube assembly is able to rotate side to side around a second axis normal to said first axis;

said rotatable delivery assembly having one or more limit arms positioned such that said limit arms restrict the angle of rotation of said tube assembly around said second axis;

said tube assembly having a first spray tube and a second spray tube, each spray tube having an input end and an output end, said tube assembly configured such that the input ends of said first spray tube and said second spray tube are adjacent to each other and may be alternatingly centered above said water nozzle;

said rudder sub-assembly having a rotatable rudder connected to a control arm, said rudder sub-assembly attached to said tube assembly such that said rudder sub-assembly is able to pivot around a third axis parallel to said second axis, with said tube assembly configured to restrict the angle of rotation of said rudder sub-assembly around said third axis, and said rudder sub-assembly positioned such that said rudder is below and between the input ends of said spray tubes, and proximal to said water nozzle; and one or more adjustable, removable directional stoppers coupled to said cage and positionable such that, during sprinkler head operation, said control arm will contact said one or more directional stoppers causing said control arm and attached rudder to pivot;

wherein, upon the flow of water through said water delivery conduit and attached water nozzle, the flow will encounter said rudder, causing said rudder to pivot around said third axis and interact with said flow such that the rudder and attached tube assembly rotate around said second axis and, upon the filling of one of said first spray tube, exert rotational force around said first axis, causing said rotatable delivery assembly to rotate around said first axis until said control arm contacts said one or more directional stoppers, which causes said control arm and said rudder to pivot around said third axis and causes said rudder to engage the flow of water such that the rudder and attached tube assembly rotate around said second axis in the opposing direction, moving the input end of the second spray tube over the water nozzle, allowing the flow to enter the second spray tube, at which point the process repeats.

11. The water distributing sprinkler head of claim 10, wherein said delivery assembly includes a dampener to modulate the rotational speed of said delivery assembly around said first axis.

12. A water distributing sprinkler head, comprising:

a water delivery source, comprising a water conduit with a water nozzle, said water conduit and water nozzle centered around a first axis;

a cage having a first end secured to said water delivery source, said first end further containing an inner rim and an outer rim, said inner rim containing one or more notches, with said outer rim containing one or more grooves;

said cage further having a second end, said second end further containing an aperture, with said first end and said second end spaced apart by one or more arms;

a rotatable delivery assembly attached to and positioned within said cage between said first end and said second end, and having a tube assembly, a hangar, and a rudder sub-assembly, said hangar attached to a bearing configured to fit securely within said aperture, said hangar mounted to said second end by inserting said bearing into said aperture, such that said rotatable delivery assembly is able to rotate side to side around said first axis, and said tube assembly coupled to said hangar such that said tube assembly is able to rotate around a second axis normal to said first axis;

said rotatable delivery assembly having a dampener to modulate the rotational speed of said delivery assembly around said first axis;

said rotatable delivery assembly having one or more limit arms positioned such that said limit arms restrict the angle of rotation of said tube assembly around said second axis;

said tube assembly having a first spray tube and a second spray tube, each spray tube having an input end and an output end, said tube assembly configured such that the input ends of said first spray tube and said second spray tube are adjacent to each other and may be alternatingly centered above said water nozzle;

said input ends of said first spray tube and/or said second spray tube are larger than said output ends of said first spray tube and/or said second spray tube, and the interior of said first spray tube and/or said second spray tube is tapered;

said first spray tube and said second spray tube further configured such that the interior contouring of said first spray tube and/or said second spray tube is modified such that the water simultaneously exiting from one or both of said output ends travels different distances thereby enabling a larger area to be watered;

said rudder sub-assembly having a rotatable rudder connected to a control arm, said rudder sub-assembly attached to said tube assembly such that said rudder sub-assembly is able to pivot around a third axis parallel to said second axis, with said tube assembly configured to restrict the angle of rotation of said rudder sub-assembly around said third axis, and said rudder sub-assembly positioned such that said rudder is below and between the input ends of said spray tubes, and proximal to but not touching said water nozzle;

said rudder sub-assembly having a retaining spring connecting said rudder sub-assembly to said tube assembly, said tube assembly configured to use the resistance of said retaining spring to maintain said rudder at a limit of its angle of rotation until encountering a force sufficient to cause said rudder to pivot toward the other limit of its angle of rotation; and one or more directional stoppers adjustably coupled to said one or more notches and/or one or more grooves of said first end and positionable such that, during sprinkler head operation, said control arm will contact said one or more directional stoppers causing said control arm and attached rudder to pivot;

wherein, upon the flow of water through said water delivery conduit and attached water nozzle, the flow will encounter said rudder, causing said rudder to pivot around said third axis and interact with said flow such that the rudder and attached tube assembly rotate around said second axis and, upon the filling of one of said first spray tube, exert rotational force around said first axis, causing said rotatable delivery assembly to rotate around said first axis until said control arm contacts said one or more directional stoppers, which causes said control arm and said rudder to pivot around said third axis and causes said rudder to engage the flow of water such that the rudder and attached tube assembly rotate around said second axis in the opposing direction, moving the input end of the second spray tube over the water nozzle, allowing the flow to enter the second spray tube, at which point the process repeats.

* * * * *